US006884177B2

(12) United States Patent
Zambelli et al.

(10) Patent No.: US 6,884,177 B2
(45) Date of Patent: Apr. 26, 2005

(54) AMUSEMENT APPARATUS

(75) Inventors: Giambattista Zambelli, Altavilla Vicentina (IT); Alberto Comand, Altavilla Vicentina (IT)

(73) Assignee: Antonio Zamperla S.p.A., Vicenza (IT)

( * ) Notice: Subject to any disclaimer, the term of this patent is extended or adjusted under 35 U.S.C. 154(b) by 0 days.

(21) Appl. No.: 10/381,565

(22) PCT Filed: Feb. 28, 2003

(86) PCT No.: PCT/IT03/00112

§ 371 (c)(1),
(2), (4) Date: May 20, 2003

(87) PCT Pub. No.: WO2004/030781

PCT Pub. Date: Apr. 15, 2004

(65) Prior Publication Data

US 2004/0077417 A1 Apr. 22, 2004

(30) Foreign Application Priority Data

Oct. 2, 2002 (IT) ..... MI2002A2084

(51) Int. Cl.[7] ..... A63G 1/34
(52) U.S. Cl. ..... 472/47; 472/45; 104/53
(58) Field of Search ..... 472/30, 44, 45, 472/47; 104/53, 55, 77, 78, 81

(56) References Cited

U.S. PATENT DOCUMENTS

| | | | | | |
|---|---|---|---|---|---|
| 1,000,305 | A | * | 8/1911 | Jontz | 104/77 |
| 1,399,577 | A | | 6/1921 | Riehl | |
| 1,528,486 | A | * | 3/1925 | Fisk | 104/77 |
| 1,564,952 | A | * | 12/1925 | Fisher | 104/77 |
| 1,723,656 | A | * | 8/1929 | Palmigiano, Jr. | 104/77 |
| 1,783,268 | A | | 2/1930 | Traver | |
| 1,745,719 | A | | 4/1930 | Sellner | |
| 2,109,539 | A | * | 3/1938 | Kornsweet | 472/44 |
| 3,366,104 | A | * | 1/1968 | Kiyoshi | 601/5 |
| 3,791,307 | A | | 2/1974 | Applegate | |
| 3,847,084 | A | | 11/1974 | Fouche | |
| 6,402,624 | B1 | * | 6/2002 | Larson et al. | 472/44 |

FOREIGN PATENT DOCUMENTS

| | | |
|---|---|---|
| WO | 99/04875 | 2/1999 |
| WO | WO9904875 | 4/1999 |

* cited by examiner

*Primary Examiner*—K. T. Nguyen
(74) *Attorney, Agent, or Firm*—Kenyon & Kenyon

(57) ABSTRACT

Amusement apparatus which permits unusual compactness and easy transportation comprises a vehicle for accommodating users, the vehicle being suitable for following a path in space which comprises a component due to oscillation about a center of instantaneous rotation and a component, due to rotation about an axis oriented variously in space. The vehicle is supported on a support structure comprising two rails the shape of which defines the shape of the component due to oscillation of the vehicle.

34 Claims, 13 Drawing Sheets

AMUSEMENT APPARATUS

FIELD OF THE INVENTION

The subject of the present invention is an amusement apparatus in which a vehicle, provided with seats, follows a path in space which comprises a component due to oscillation about a centre of instantaneous rotation and a component due to rotation about an axis.

More particularly, the present invention relates to an amusement apparatus in which the above-mentioned vehicle follows a path defined by an oscillation relative to a fixed centre and by a rotation relative to an axis that is inclined in various ways in space.

BACKGROUND OF THE INVENTION

In the field of amusement apparatus, there is a particular need to maintain compactness and to simplify transportation and installation, particularly for mobile structures.

There are known amusement apparatuses in which the oscillatory movement of a vehicle is brought about by means of a complex structure formed by lattice members which define the centre of oscillation of the vehicle and on which the vehicle is substantially suspended by means of at least one arm. A combination of an oscillatory motion and of a rotational motion about an axis extending through the centre of oscillation is obtained by setting in rotation the arm on which the vehicle is suspended.

As is known, amusement apparatuses as described above are particularly bulky and complex and are difficult to transport and to fit in restricted spaces, particularly because of the presence of the lattice structure on which the vehicle is suspended.

The object of the present invention is to devise and to provide an amusement apparatus which satisfies the above-mentioned need and which at the same time overcomes the disadvantages discussed above.

SUMMARY OF THE INVENTION

This object is achieved by means of an amusement apparatus of the type specified above, formed in accordance with claim 1.

BRIEF DESCRIPTION OF THE DRAWINGS

Further characteristics and the advantages of the apparatus according to the invention will become clear from the following description of a preferred embodiment thereof which is given by way of non-limiting example with reference to the appended drawings, in which.

DETAILED DESCRIPTION OF THE PREFERRED EMBODIMENT OF THE INVENTION

With reference to the above-mentioned drawings, an amusement apparatus according to the present invention is generally indicated 10. A substantially horizontal support surface of the apparatus 1 is indicated P in the appended drawings. Any plane perpendicular to this surface will be referred to generally as a vertical plane.

Figure 1:
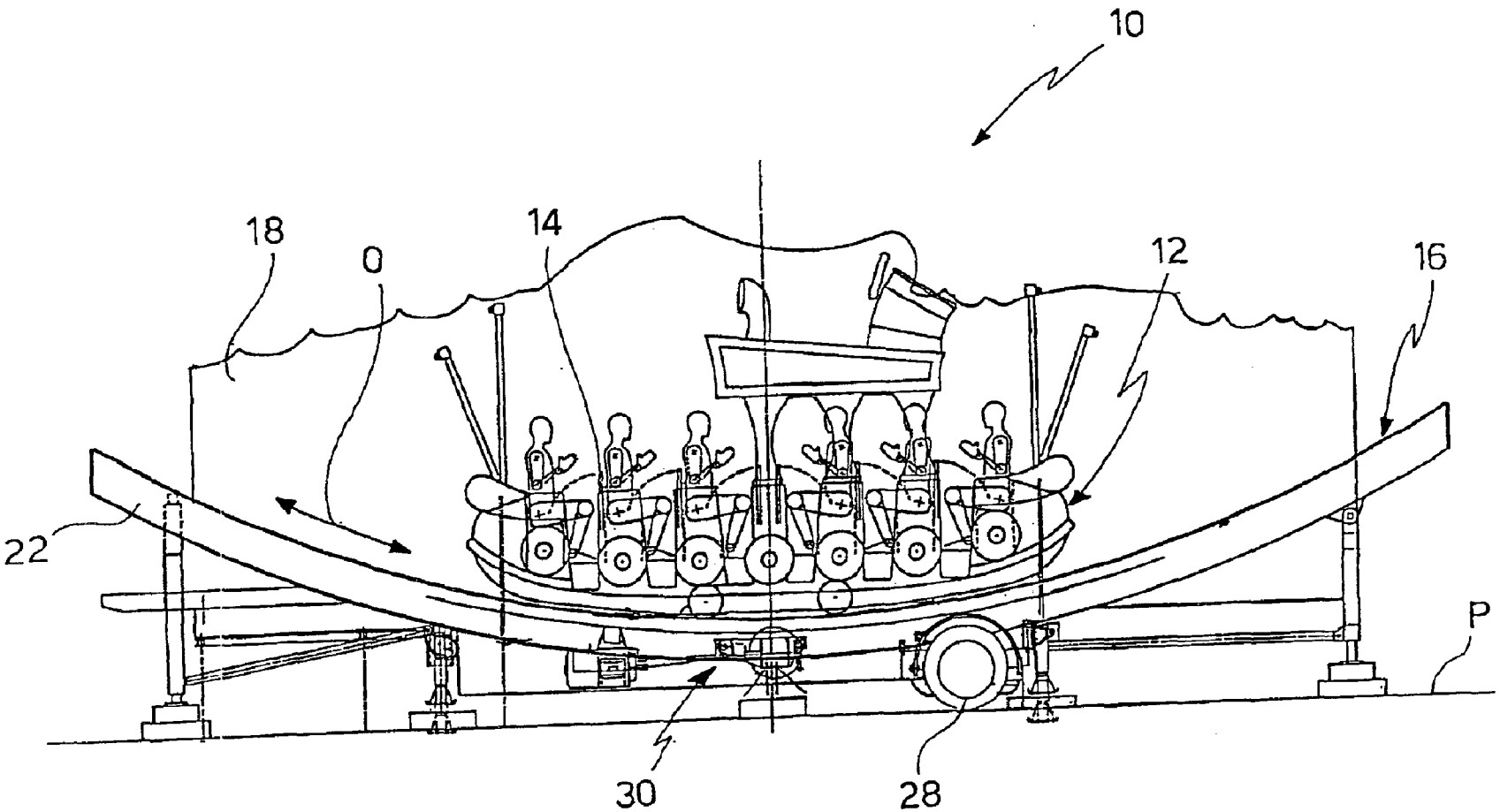
FIG. 1 is a front view of an amusement apparatus according to the present invention.
Figure 2:
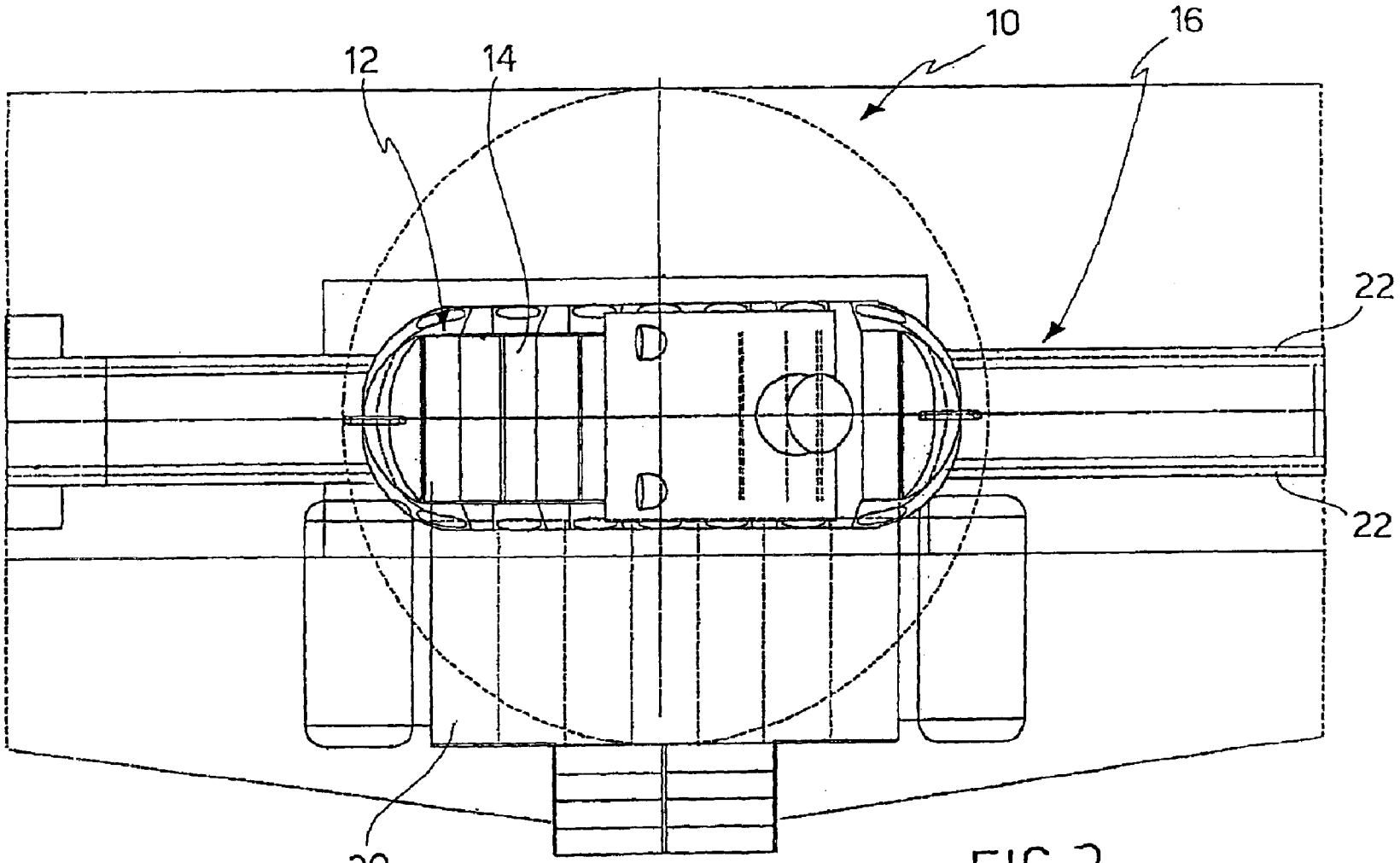
FIG. 2 is a view of the apparatus of FIG. 1 from above.
Figure 3:
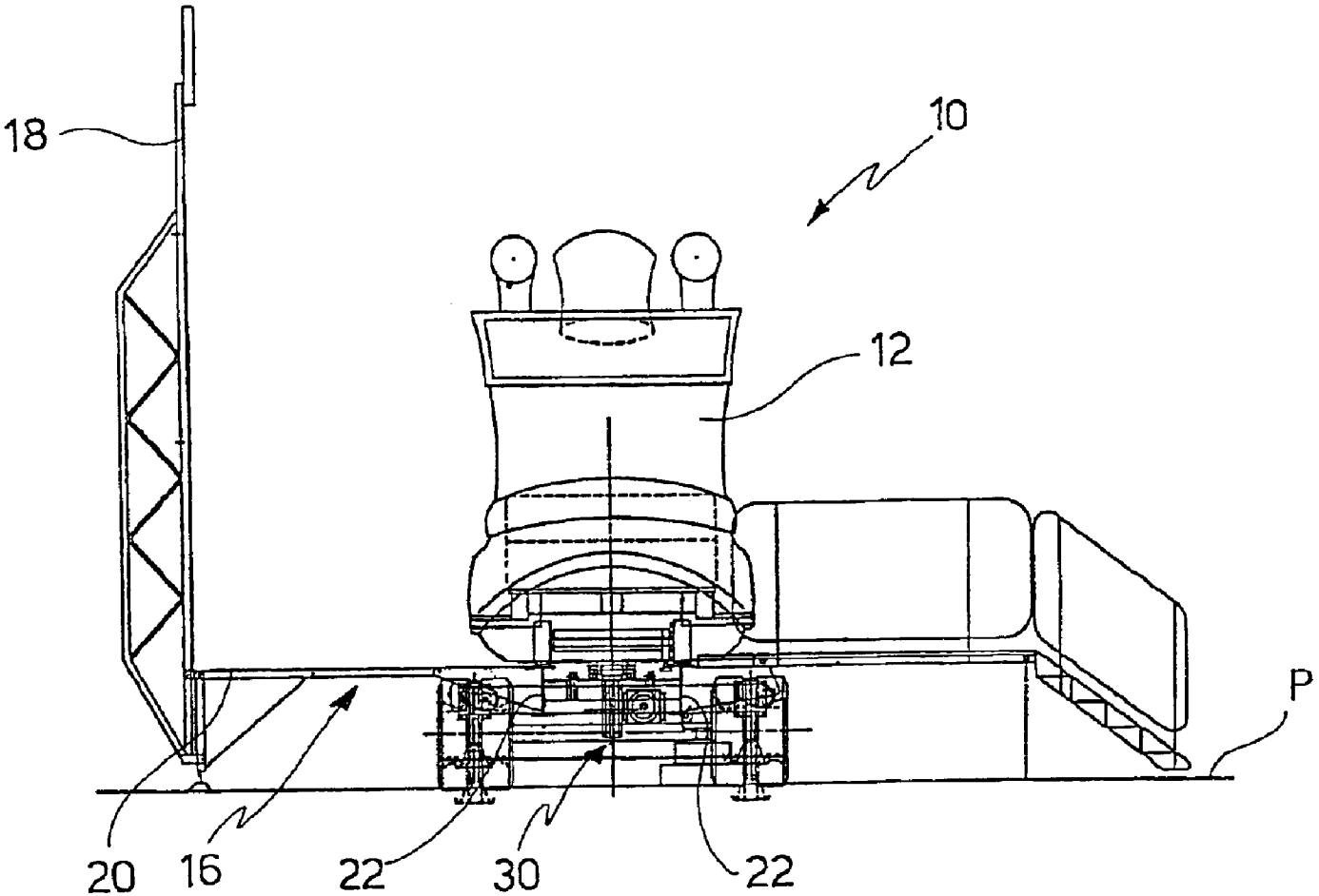
FIG. 3 is a side view of the apparatus of FIG. 1.

A vehicle, indicated 12, is suitable for accommodating a predetermined number of users or passengers, for example, in parallel rows of seats 14 as shown in FIG. 1. In further possible embodiments, the seats may be arranged differently, for example, in longitudinal rows relative to the extent of the vehicle 12, or in a circle.

The vehicle 12 may be of an imaginative shape and comprises portions that can move in space along paths as described below.

A support structure, generally indicated 16, is suitable for supporting the vehicle 12 and for defining, at least partially, a component of its path in space.

According to one possible embodiment, the support structure 16 is produced in a compact and foldable form which also defines the trailer on which the apparatus 10 is transported.

The support structure 16 or load-bearing structure for the vehicle is advantageously combined with the chassis of the trailer, simplifying both the movement and the assembly of the apparatus.

FIG. 1 shows an embodiment of the support structure 16 in which there is a rear wall 18 suitable for creating the background scenery of the apparatus and a substantially horizontal surface 20 which constitutes an access platform disposed at the lowest level at which the vehicle 12 can be arranged.

The support structure 16 further comprises two rails 22 on which the vehicle 12 is supported. These rails have a shape such as to define a predetermined component of the path of the vehicle 12.

The shape of the rails 22, and hence of the component of the path defined thereby, follows a suitable curve which is selected in dependence on the sensation to be given to the passengers.

According to one possible embodiment, for example, that shown in the appended drawings, the rails 22 follow a curved path within a plane so that the component of the path of the vehicle is a curved component in that plane, for example, in a vertical plane.

According to one possible embodiment, the shape of the rails 22, and hence of the component of the path of the vehicle defined thereby, corresponds to a concave portion of a circle.

In other embodiments, not shown, the rails may have a curved or undulating shape or other shapes suitable for creating particular sensations for the user of the vehicle.

According to one possible embodiment, for example, that shown in the drawings, the two rails 22 are arranged parallel to one another, defining a major axis, indicated O. According to one possible embodiment, each rail comprises a profiled section having, for example, an "I"-shaped cross-section which has a shape, along its major axis, suitable for producing the desired path component. As defined above, the profiled section may have an arcuate shape, for example, a sector of a circle, or other configurations suitable for creating a predetermined sensation for the user.

The movement of the vehicle 12 along the rails 22 defines a swinging movement of the vehicle along a curve which, according to various possible embodiments, may have a fixed and/or a variable centre of instantaneous rotation.

Uprights and cross-members arranged appropriately beneath the two rails to support and reinforce the support structure 16 advantageously also define elements of the trailer of the vehicle 12.

Figure 4:
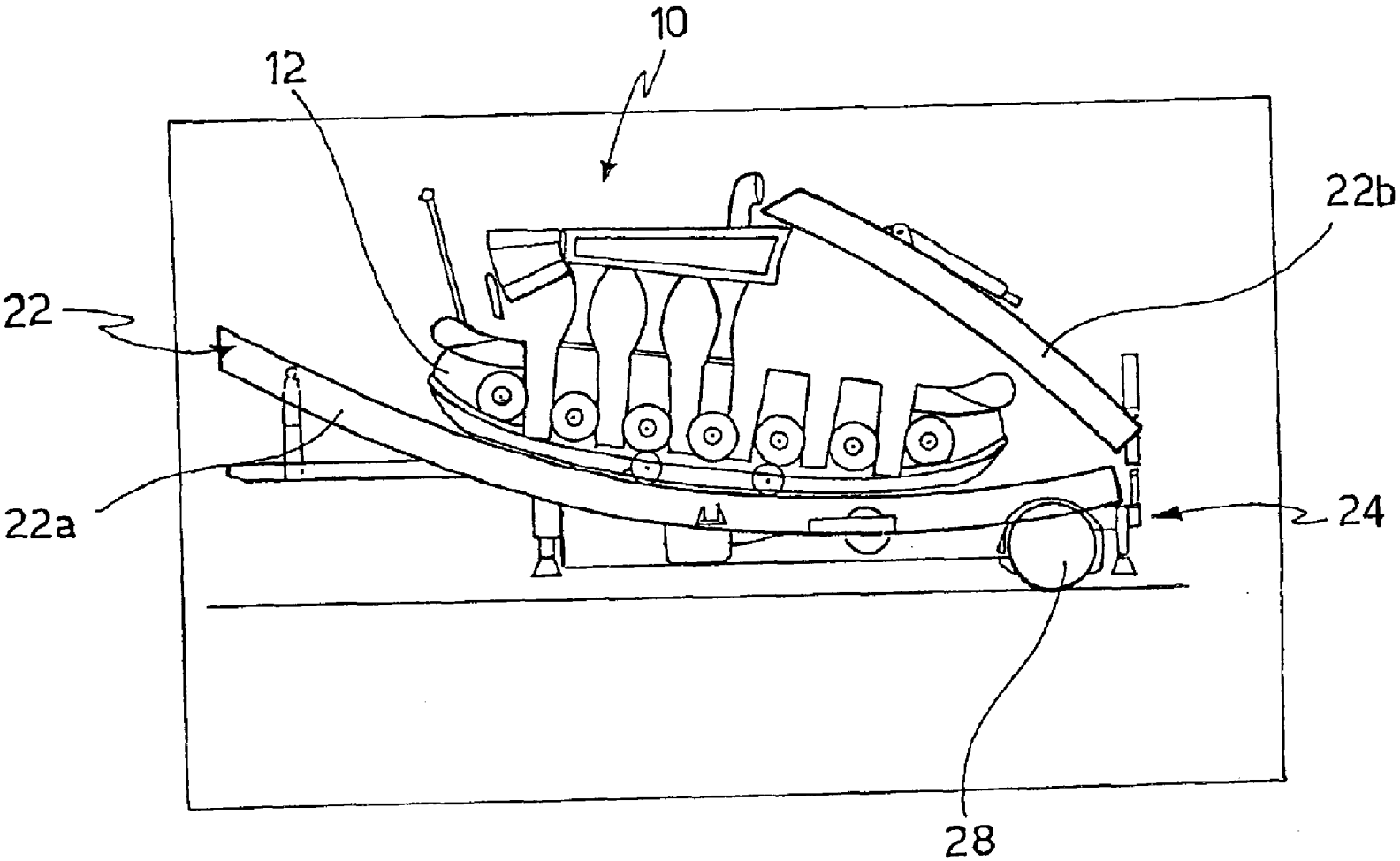
FIG. 4 is a front view of the apparatus of FIG. 1 in a different operative condition.
Figure 5:
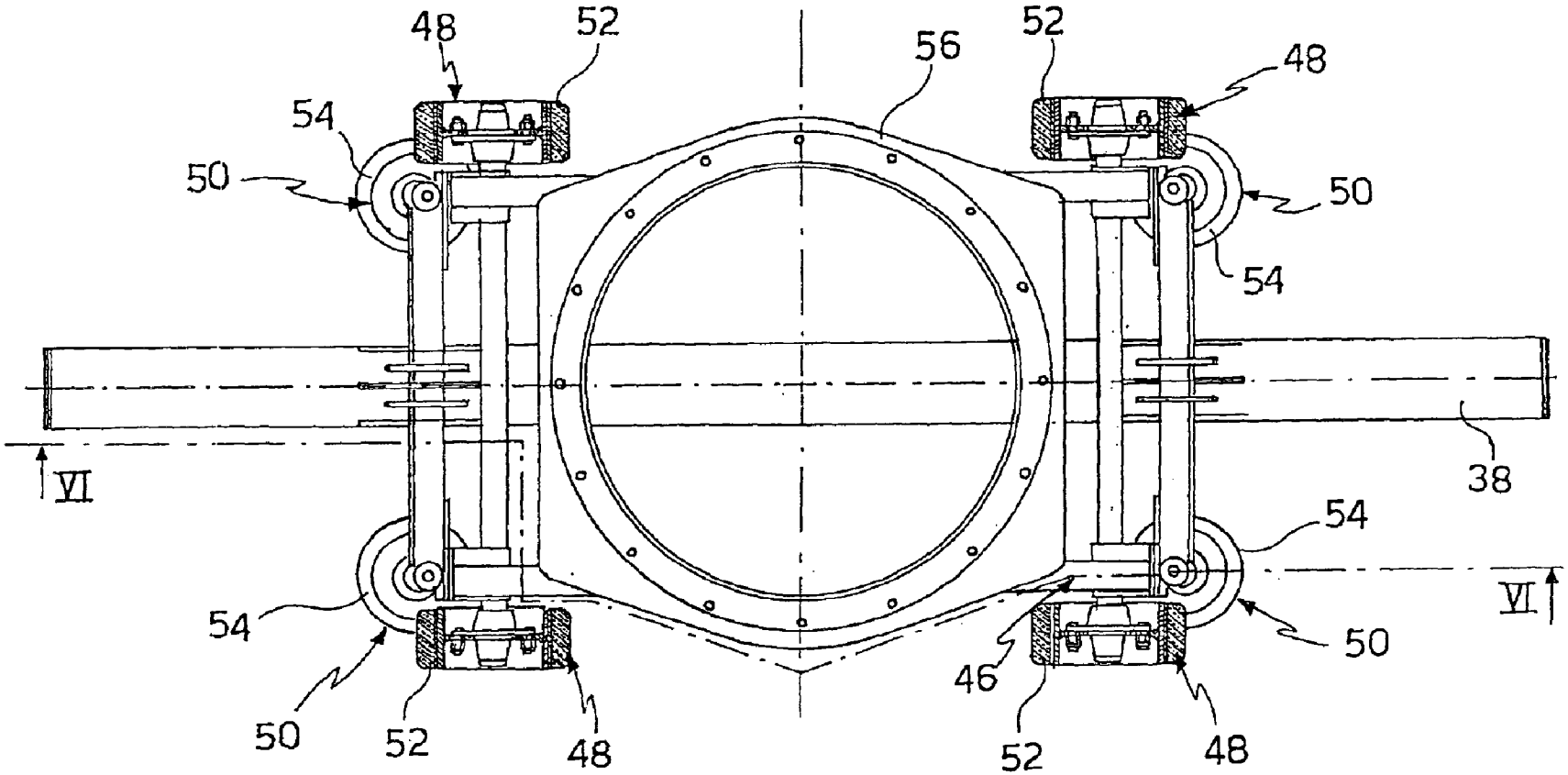
FIG. 5 is a view of a detail of the apparatus of FIG. 1 from above.
Figure 6:
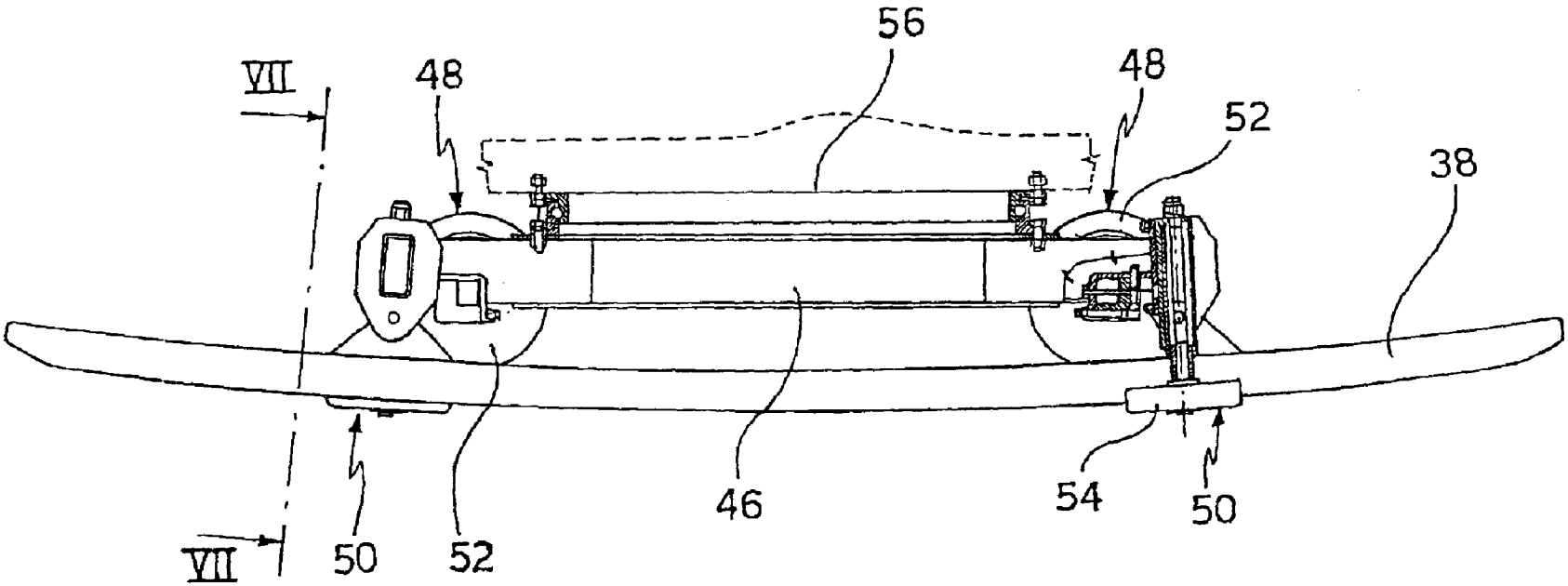
FIG. 6 is a section taken on the line VI—VI through the detail of FIG. 5.
Figure 7:
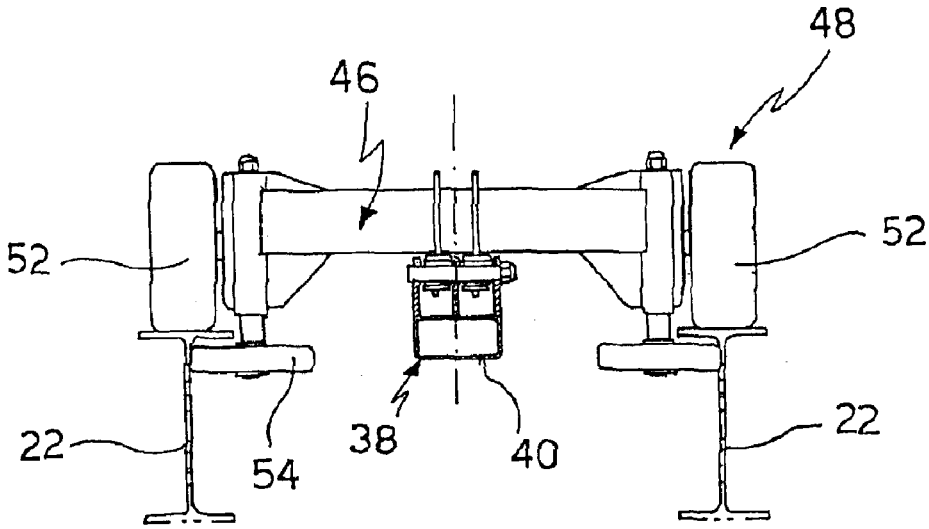
FIG. 7 is a section through the detail of FIG. 5, taken on the line VII—VII of FIG. 6.
Figure 8:
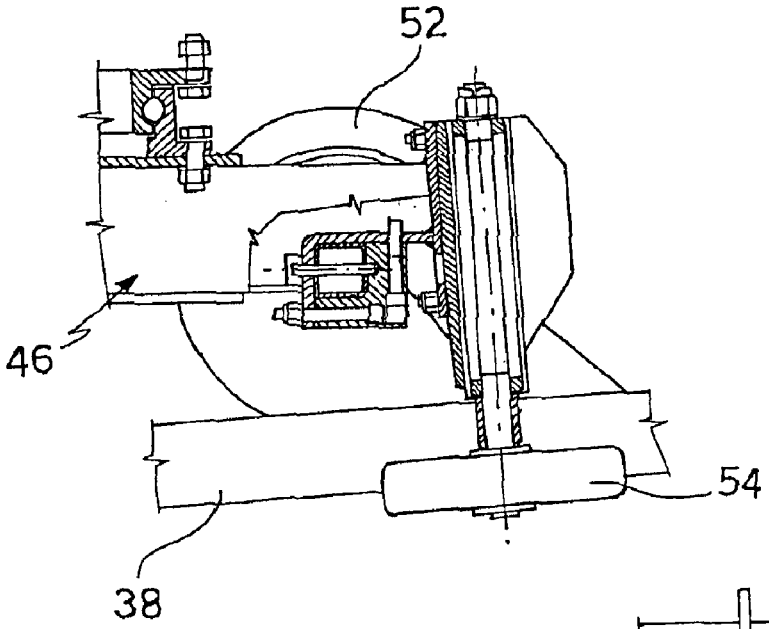
FIG. 8 shows a portion of the detail of FIG. 6 on an enlarged scale.
Figure 9:
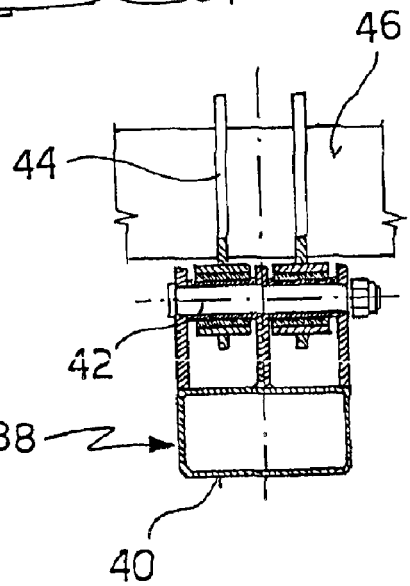
FIG. 9 shows a portion of a detail of FIG. 7 on an enlarged scale.
Figure 11:
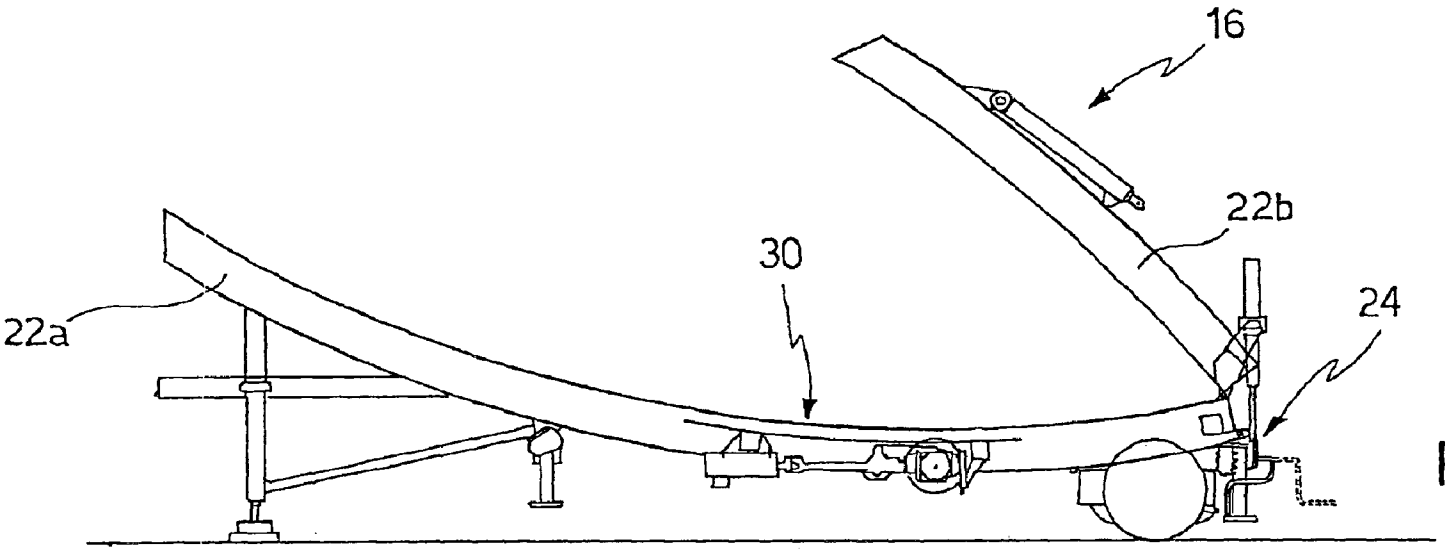
FIG. 11 is a partially-sectioned front view of the detail of FIG. 10.

According to one possible embodiment, each rail 22 is formed in at least two portions which are articulated to one another in a manner such that one of the two portions, preferably the end portion, can pivot relative to the other, preferably about a horizontal axis substantially perpendicular to the axis of the rails. In FIGS. 4 and 11, the two portions of a rail are indicated 22*a* and 22*b*, respectively, and are shown in the folded position for making the support structure 16 compact.

Figure 12:
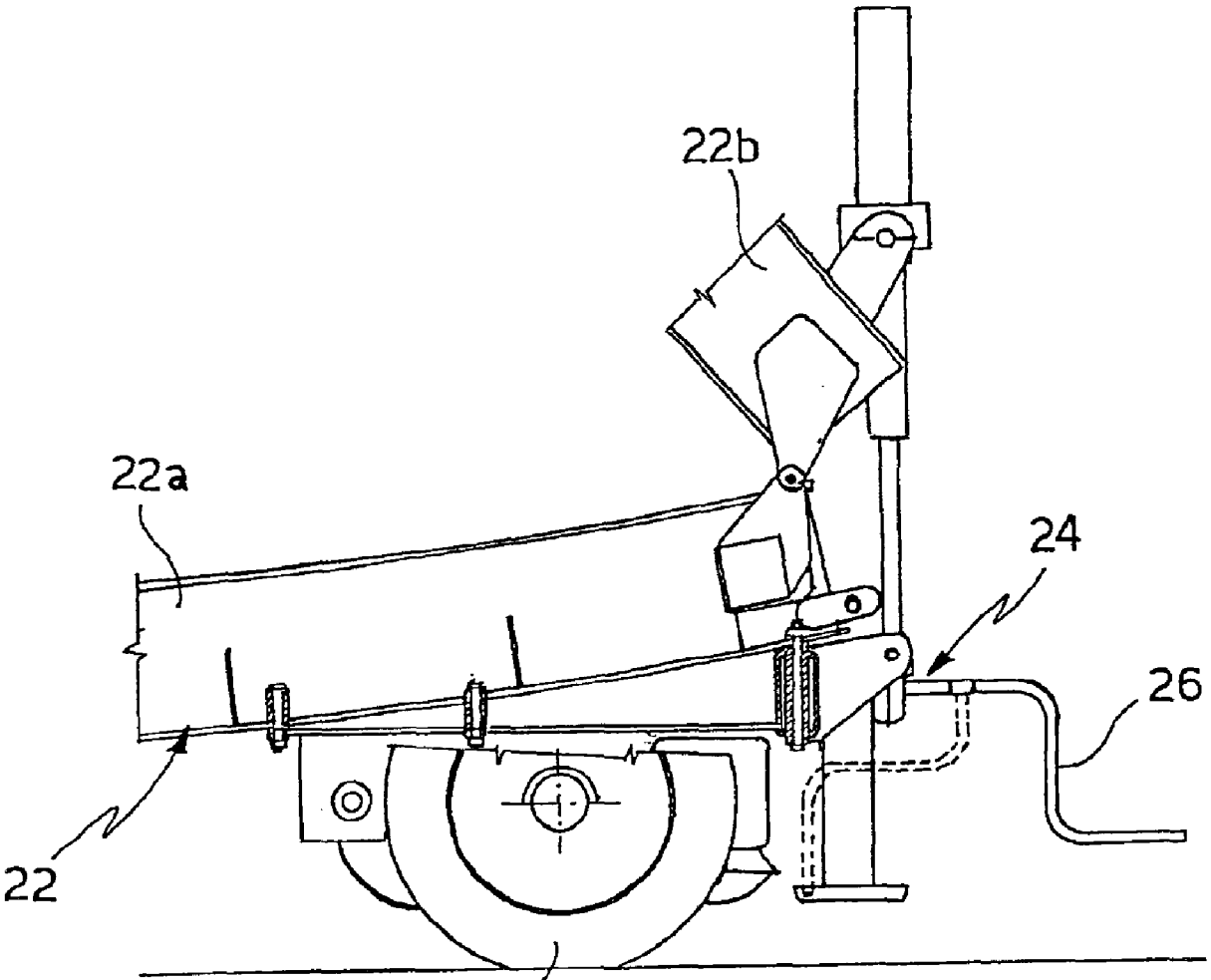
FIG. 12 shows a portion of the detail of FIG. 11 on an enlarged scale.

FIG. 12 shows in detail the portion of the rails 22 in which the two portions 22*a* and 22*b* are articulated to one another. Means for positioning the two portions relative to one another are indicated 24 and are shown in FIG. 12 in the configuration corresponding to the folded position of the rails 22.

Figure 18:
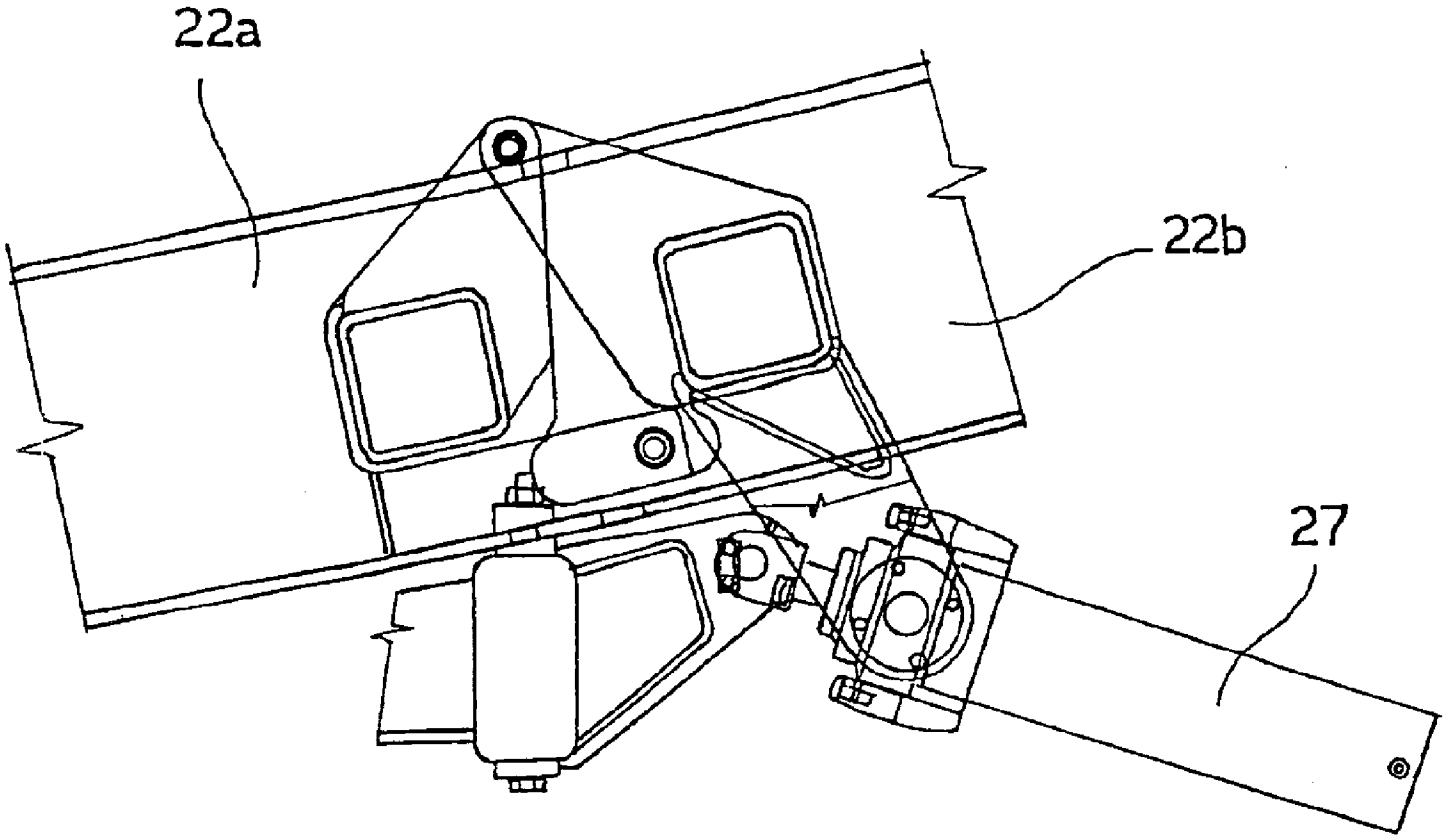
FIG. 18 is an enlarged side view of a detail of FIG. 12, according to one possible embodiment.

According to one possible embodiment, the relative positioning means 24 comprise a crank 26, which is preferably foldable, and an oleodynamic cylinder 27 operatively interposed between the two portions 22*a* and 22*b*. FIG. 18 shows a detail of the cylinder and of the articulation between the two portions 22*a* and 22*b*.

According to one possible embodiment, the support structure 16 is advantageously suitable for forming a transportation trailer (FIG. 4) by folding of the rails 22 as shown in FIG. 4 or FIG. 11. The support structure 16 preferably has wheels 28 for the support and towing of the structure.

Figure 10:
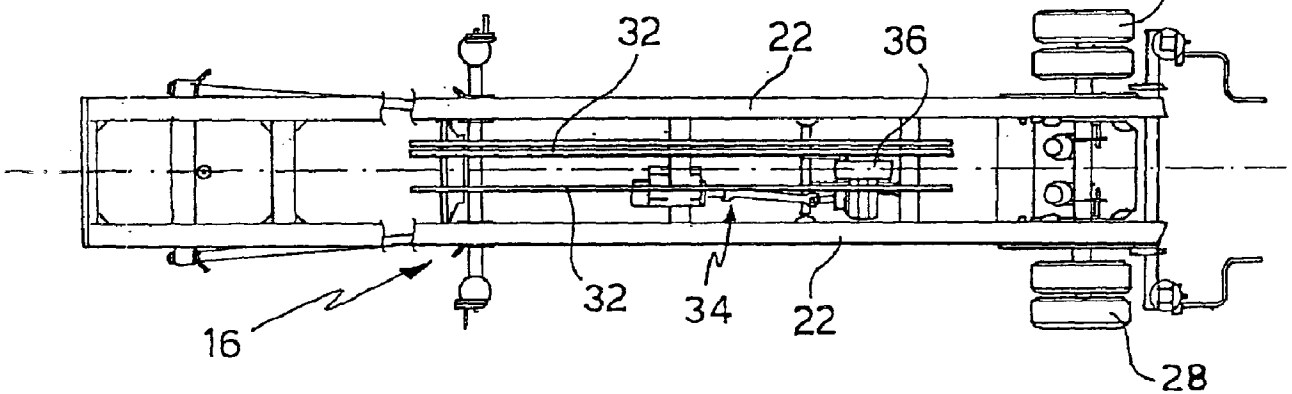
FIG. 10 shows a detail of the apparatus of FIG. 1 from above.

According to one possible embodiment, for example, that shown in FIGS. 10 and 11, the support structure 16 comprises first drive means 30 for causing the vehicle 12 to oscillate along the major axis of the rails 22, producing a swinging motion of the vehicle along the path component defined by the rails. As shown, for example, in FIG. 10, the first drive means 30 are disposed between the two rails 22, for example, on walls 32 also disposed between the two rails 22 and parallel thereto.

The first drive means 30 comprise a drive element 34 connected to cross-members of the support structure 16 and operatively connected to a driving wheel 36 mounted between the two walls 32. The axis of rotation of the driving wheel 36 is arranged along a substantially horizontal axis perpendicular to the major axis of the rails 22 (FIG. 10).

According to one possible embodiment, the rails 22 have sensor means suitable for reading the position of the vehicle relative to the support structure in order to reverse the direction of oscillation of the vehicle.

The driving wheel 36 interacts with a portion of the vehicle 12 which is preferably arranged between the two rails 22. According to one possible embodiment, the base of the vehicle 12, that is, the portion facing the support structure 16, comprises a thrust track 38.

According to one possible embodiment, the thrust track 38 is arcuate with a configuration similar to that of the rails 22.

The thrust track 38 has a surface 40 for contact with the driving wheel 36, preferably coinciding with a lower surface of the thrust track. According to one possible embodiment, the thrust track 38 is suitable for being arranged between the walls 32 of the support structure 16 when the vehicle is positioned on the rails 22.

According to one possible embodiment, the thrust track 38 is formed by a hollow profiled section connected, by means of pins 42 and stirrups 44, to a framework 46 disposed beneath the vehicle 12.

According to one possible embodiment, the framework 46 of the vehicle 12 comprises elements 48 for its support on the rails 22 and elements 50 for its lateral restraint thereon. According to one embodiment, the support elements 48 comprise first wheels 52 which bear on the rails 22, for example, on the upper flat end of the "I"-shaped profiled section. With respect to the framework 46, the first wheels 52 are mounted for rotating about axes which are substantially perpendicular to the major axis of the rails 22, that is, which are arranged transversely relative to the thrust tracks 38 and to the axis O of the component due to the oscillation of the vehicle on the rails 22, and are arranged parallel to the horizontal support surface P of the apparatus 1.

According to one embodiment, the lateral restraint elements 50 comprise second wheels 54 mounted for rotating about axes substantially perpendicular to the major axis of the rails 22 and arranged individually in substantially vertical planes relative to the horizontal support surface P. In the embodiment shown, the second wheels 54 are mounted so as to run on the inner walls of the rails 22, for example, on the inner surfaces of the vertical walls of the "I"-shaped profiled sections.

According to one possible embodiment, the vehicle 12 comprises a carriage 56 mounted on the framework 46 in a manner such that the carriage and the upper portion of the vehicle can rotate about an axis R—R.

During the oscillatory or swinging motion of the vehicle 12 on the rails 22, the axis R—R can be oriented in space in various ways. According to a possible non-limiting embodiment shown in the drawings, the axis R—R may be perpendicular to the oscillation or swing axis O and disposed in a vertical plane with respect to the horizontal surface P. According to another possible embodiment, the axis R—R may correspond substantially to the axis of the radius of curvature of the rails 22.

Figure 13:
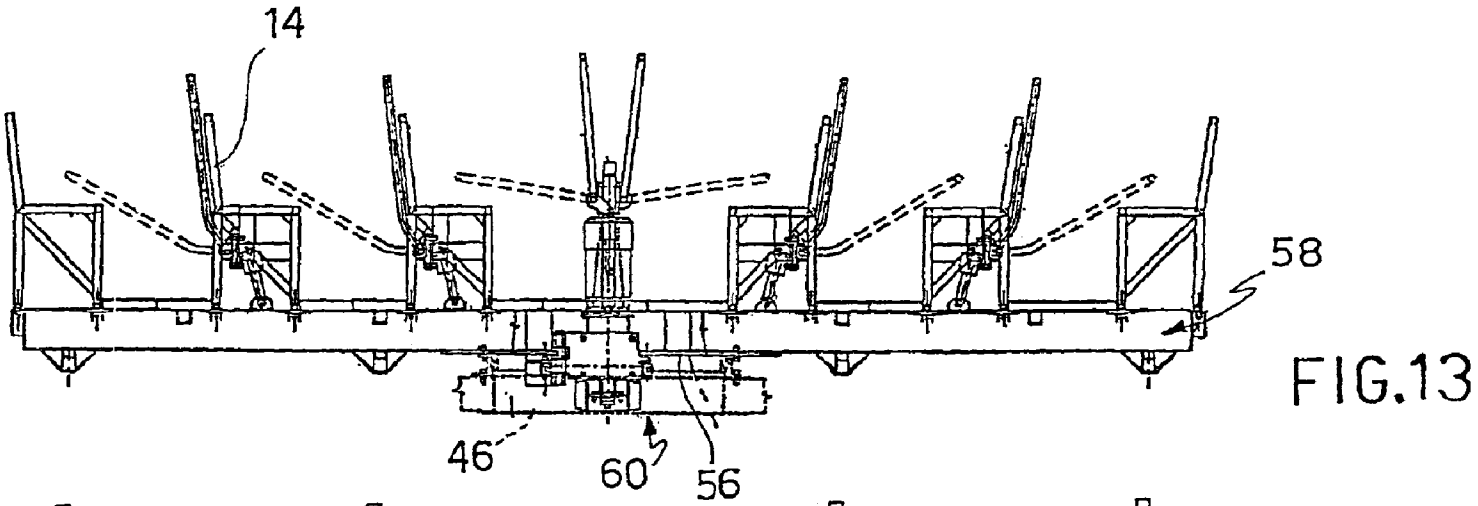
FIG. 13 is a front view of a detail of the apparatus of FIG. 1.
Figure 16:
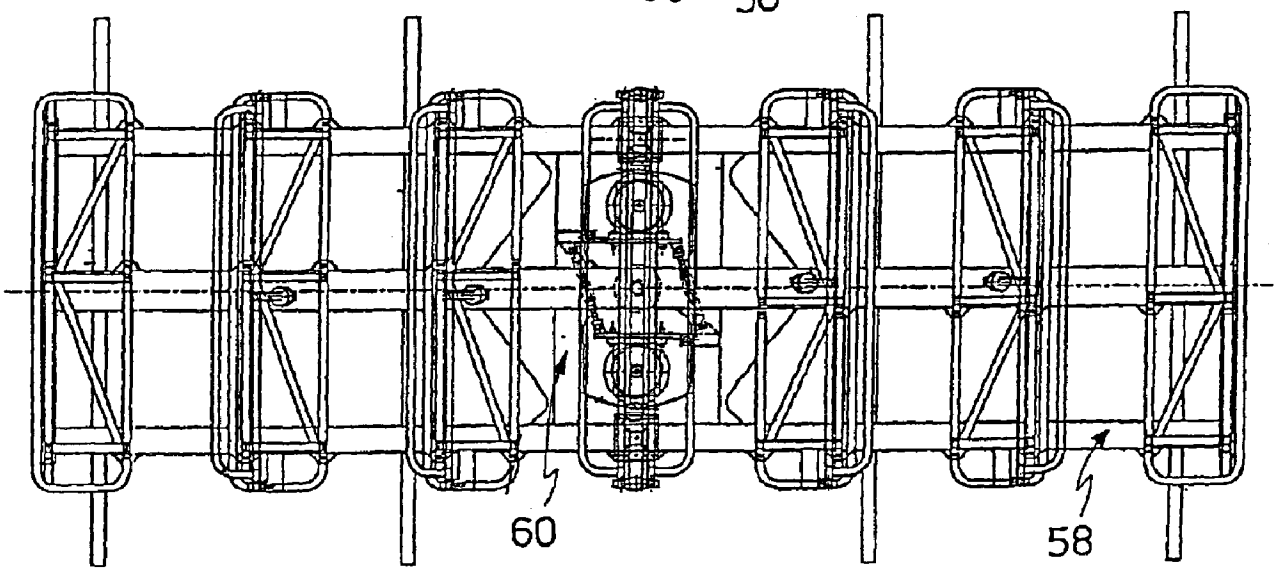
FIG. 16 shows the detail of FIG. 13 from above.
Figure 14:
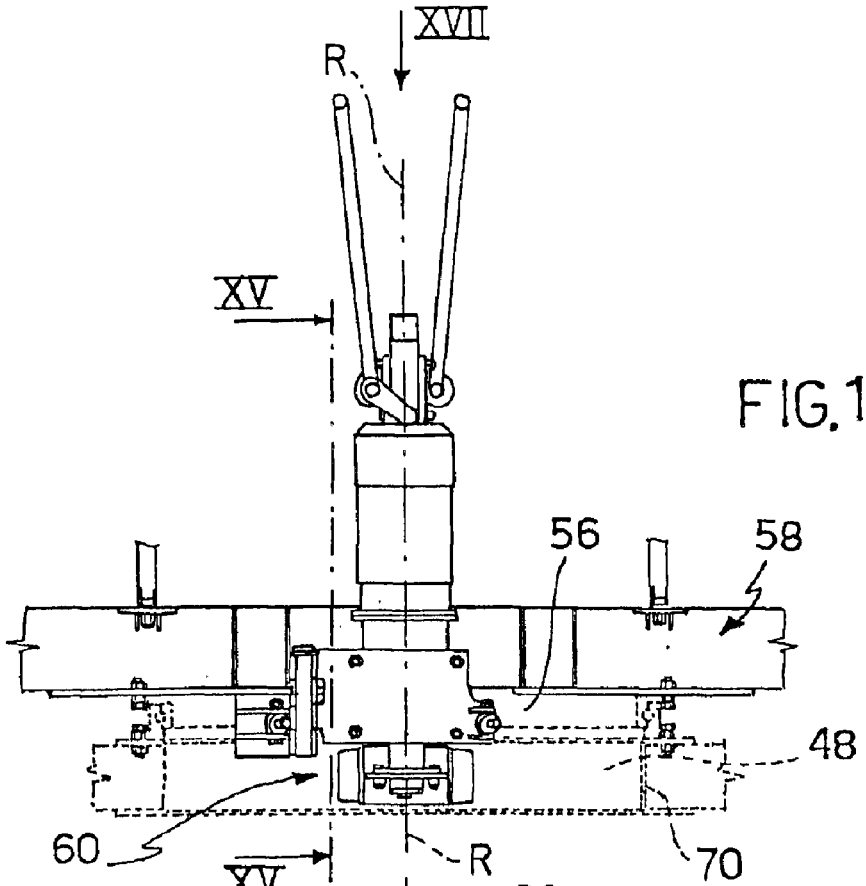
FIG. 14 shows a portion of the detail of FIG. 13 on an enlarged scale.
Figure 17:
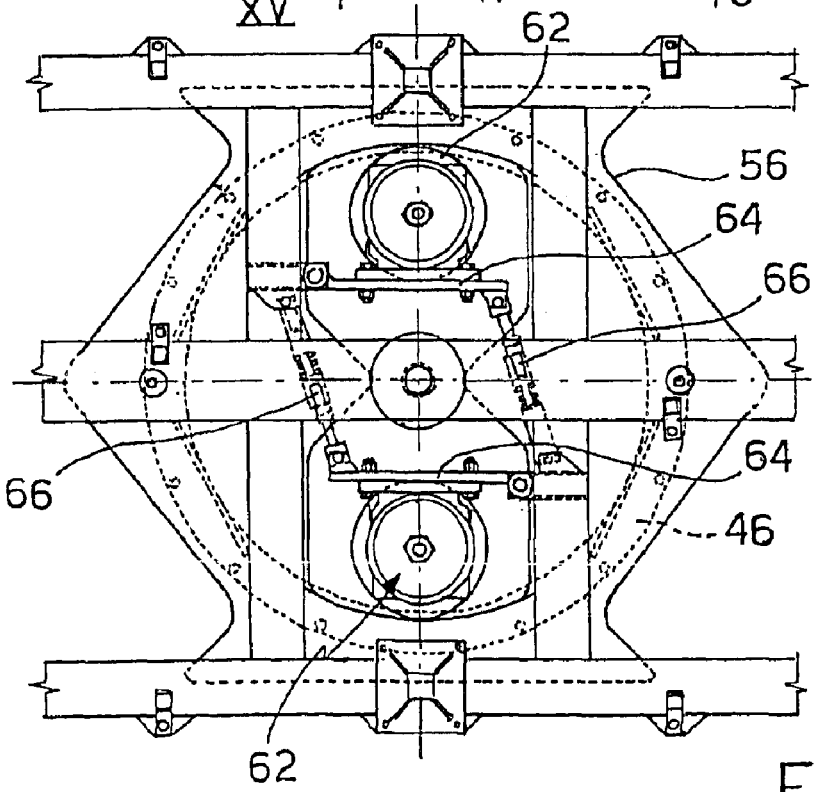
FIG. 17 is a view of the enlarged portion of FIG. 14 from above, taken on the arrow XVII.
Figure 15:
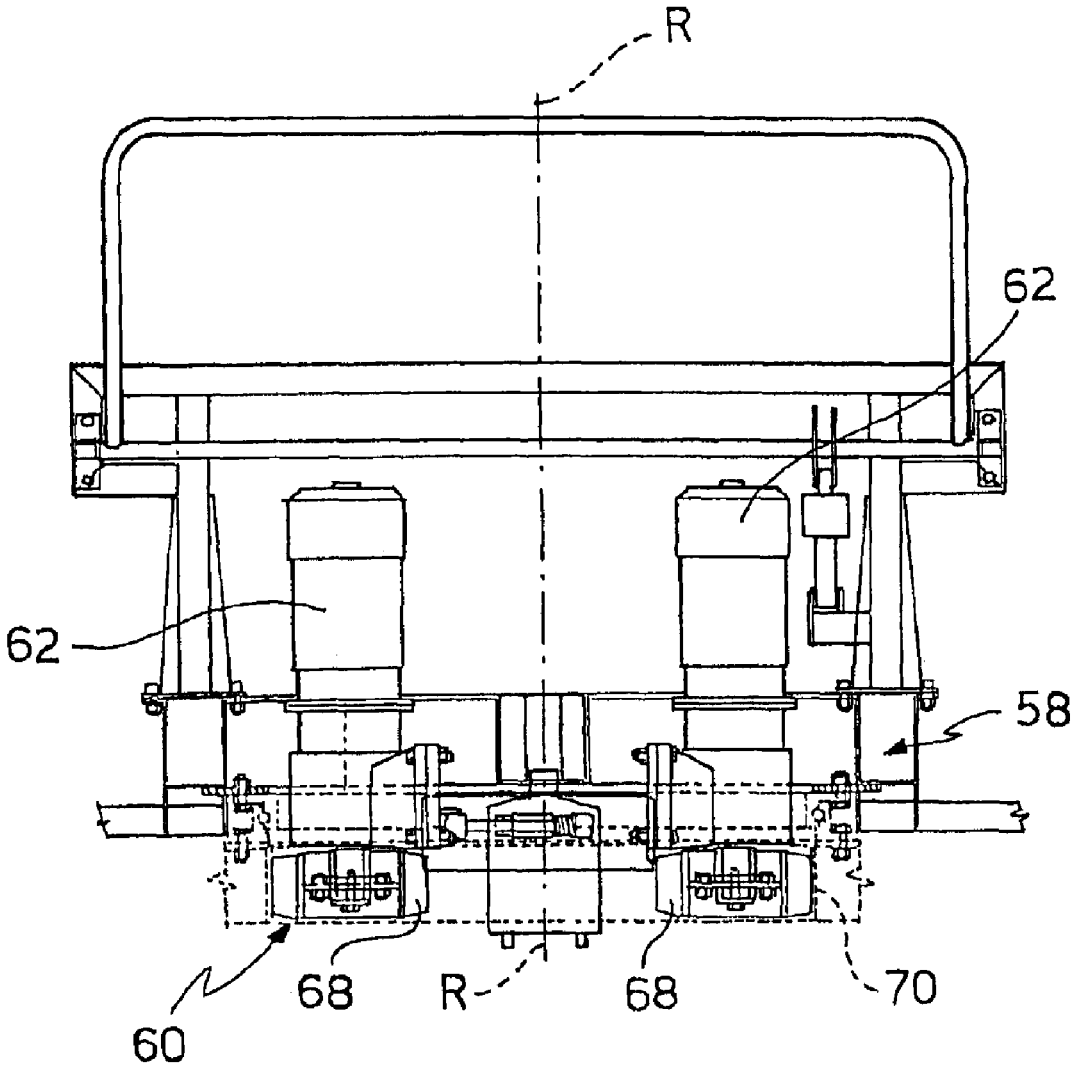
FIG. 15 shows the portion of FIG. 14, sectioned on the line XV—XV.

As shown in FIG. 13, the carriage 56 is mounted beneath a surface 58 for supporting the seats 14 for the users of the apparatus 1.

Second drive means, indicated 60, are suitable for setting the carriage 56, and hence the support surface 58, in rotation about the axis R—R.

According to one possible embodiment, the second drive means 60 comprise two drive elements 62 mounted on plates 64 articulated to the support surface 58 on opposite sides of the rotation axis R—R. Respective thrust elements 66 are operatively interposed between the plates 64 and the support surface 58. Each drive element 62 is connected to a drive wheel 68. Both of the drive wheels 68 cooperate with the inner surface of a circular ring gear 70 fixed firmly to the framework 46, as a result of the thrust exerted by the thrust elements 66.

With reference to the above-mentioned drawings, the amusement apparatus 10 operates as follows.

The first drive means 30 bring about the swinging or oscillation of the vehicle along the axis O on the rails 22. The shape of the rails defines the shape of the "swinging" component of the path of the vehicle. If rails shaped as sectors of circles are provided, the vehicle oscillates about a substantially fixed centre corresponding to the centre of the circle along which the rails extend, whilst the vehicle is supported on the rails.

If rails of other shapes are provided, the "swinging" component of the motion of the vehicle will follow the shape of the rails, which depends on the sensation to be given to the passengers.

"Swinging motion" or "swinging component" therefore means the motion of the vehicle along the rails 22 which is brought about by the first drive means, both in one direction and in the other direction. Sensor means identify the reaching of the ends of the path of swinging in order to reverse the drive of the first drive means and thus to reverse the direction of travel of the vehicle on the rails.

During the swinging motion, a portion of the vehicle corresponding to the carriage 56 and to the support surface 58 on which the users are located is set in rotation by the second drive means 60, producing a combination of a swinging motion along a path defined by the shape of the rails and a rotational motion about an axis R—R.

In particular, the carriage and the support surface 58 rotate about an axis R—R which can be oriented in various ways in space.

According to one possible embodiment, the first and second drive means are not synchronized with one another, so that the position of the carriage 56 and of the support surface 58 in space does not recur when the framework 46 is in a predetermined position.

It will be appreciated from the foregoing that the provision of an amusement apparatus according to the present invention satisfies the above-mentioned need for compactness.

Moreover, the amusement apparatus according to the invention facilitates both transportation and assembly, avoiding complex lattice structures and combining the load-bearing structure of the apparatus and the framework of the transportation trailer.

Since the vehicle is supported on the rails, the shape of the rails define the shape of the swinging or oscillation component of the vehicle's path. Moreover, the rotational component can be performed about an axis R—R that is oriented in various ways in space.

The advantageous combination of a swinging motion performed on rails and of a rotational motion about an axis R—R that is oriented in various ways in space permits more versatile design of the possible final paths that can be achieved, in accordance with users' ever more varied requirements. In fact, the present invention enables the two components of the motion to be rendered structurally and functionally independent.

A further advantage of the amusement apparatus according to the invention lies in its unusual structural simplicity which enables it to be produced at a very low cost.

Naturally, variations and/or additions may be provided for the embodiment described and illustrated above.

For example, the shape and number of rails may vary from that shown in the drawings, for example, by the provision of a single rail or of a larger number of rails. The configurations of the first and second drive means may differ from those described and illustrated.

The shape of the rails may, for example, be arcuate, undulating, or in any case arranged according to the motion to be produced and the consequent sensation to be given the passengers. The axis of rotation R—R may also be oriented in various ways in space. Amongst the possible but non-limiting examples, the axis of rotation R—R may extend through the centre of instantaneous rotation of the path of the swinging motion, or may be oriented differently relative thereto.

Moreover, the second drive means may be constructed in a manner such as to produce either a monodirectional or a bi-directional rotational component of the motion.

The rows of seats may be positioned variously in longitudinal, transverse, or circular rows.

In order to satisfy contingent and specific requirements, a person skilled in the art may apply to the above-described preferred embodiment of the apparatus many modifications, adaptations, and replacements of elements with other functionally equivalent elements without, however, departing from the scope of the appended claims.

What is claimed is:

1. Amusement apparatus comprising a vehicle for accommodating users, the vehicle being suitable for following a path in space the vehicle oscillatable about a center of instantaneous rotation and the vehicle rotable about an axis that is movable with the vehicle in accordance with oscillation of the vehicle, characterized in that the vehicle is supported on a support structure comprising at least one rail the shape of which defines the shape of the oscillation of the vehicle.

2. Amusement apparatus according to claim 1 in which the axis of rotation is oriented in space so as to extend through the center of instantaneous rotation of the component due to oscillation of the vehicle.

3. Amusement apparatus according to claim 1 in which the support structure comprises two rails arranged parallel to one another and defining a major axis.

4. Amusement apparatus according to claim 1 in which the at least one rail extends along a curve depending on the sensation to be given to the users.

5. Amusement apparatus according to claim 4 in which the at least one rail extends along a sector of a circle.

6. Amusement apparatus according to claim 1 in which the at least one rail comprises a profiled section.

7. Amusement apparatus according to claim 6 in which the profiled section has an "I"-shaped cross-section.

8. Amusement apparatus according to claim 1 in which the vehicle comprises a thrust track for its movement along the at least one rail.

9. Amusement apparatus according to claim 8 in which the thrust track has a contact surface interacting with the first drive means.

10. Amusement apparatus according to claim 1 in which the vehicle comprises elements for its support on the at least one rail.

11. Amusement apparatus according to claim 10 in which the support elements comprise first wheels which bear on the at least one rail.

12. Amusement apparatus according to claim 1 in which the vehicle comprises elements for its lateral restraint on the at least one rail.

13. Amusement apparatus according to claim 11 in which the lateral restraint elements comprise second wheels.

14. Amusement apparatus according to claim 1 in which the vehicle comprises a carriage suitable for rotating about an axis which is oriented in space in dependence on the sensation to be achieved.

15. Amusement apparatus according to claim 14 in which, during the oscillatory motion of the vehicle on the at least one rail, the axis of rotation is perpendicular to an oscillation axis and is disposed in a plane which is vertical with respect to a horizontal support surface.

16. Amusement apparatus according to claim 1 in which second drive means are provided and can set the carriage in rotation about the axis.

17. Amusement apparatus according to claim 16 in which the second drive means comprise two drive elements disposed on opposite sides of the axis of rotation.

18. Amusement apparatus according to claim 17 in which the drive elements are articulated to the carriage and in which respective thrust elements are operatively interposed between the carriage and the drive elements.

19. Amusement apparatus according to claim 16 in which the first and second drive means are not synchronized with one another.

20. Amusement apparatus according to claim 16 in which the first and second drive means are structurally and functionally independent.

21. Amusement apparatus according to claim 1, wherein the rail is substantially stationary at least for a duration of a ride by the users.

22. Amusement apparatus according to claim 1, wherein the axis and another axis through which the center of instantaneous rotation passes are perpendicular.

23. Amusement apparatus comprising a vehicle for accommodating users, the vehicle being suitable for following a path in space the vehicle oscillatable about a center of instantaneous rotation and the vehicle rotable about an axis, that is movable with the vehicle in accordance with oscillation of the vehicle, the vehicle is supported on a support structure comprising at least one rail the shape of which defines the shape of the oscillation of the vehicle, wherein the at least one rail comprises at least two portions the relative position of which can adopt a transportation configuration and a configuration of use.

24. Amusement apparatus according to claim 23 in which the at least two portions are articulated to one another.

25. Amusement apparatus according to claim 23 in which means are provided for the relative positioning of the two portions of the at least one rail.

26. Amusement apparatus comprising a vehicle for accommodating users, the vehicle being suitable for following a path in space the vehicle oscillatable about a center of instantaneous rotation and the vehicle rotable about an axis, that is movable with the vehicle in accordance with oscillation of the vehicle, the vehicle is supported on a support structure comprising at least one rail the shape of which defines the shape of the oscillation of the vehicle, wherein the support structure comprising the at least one rail is provided with wheels for the support and towing of the structure.

27. Amusement apparatus comprising a vehicle for accommodating users, the vehicle being suitable for following a path in space the vehicle oscillatable about a center of instantaneous rotation and the vehicle rotable about an axis, that is movable with the vehicle in accordance with oscillation of the vehicle, the vehicle is supported on a support structure comprising at least one rail the shape of which defines the shape of the oscillation of the vehicle, wherein the support structure comprises first drive means for causing the vehicle to oscillate along a major axis of the rails.

28. Amusement apparatus according to claim 27 in which the first drive means are disposed between two rails.

29. Amusement apparatus according to claim 27 in which the first drive means comprise a drive element operatively connected to a driving wheel.

30. Amusement apparatus according to claim 29 in which the driving wheel is disposed between walls.

31. Amusement apparatus comprising a vehicle for accommodating users, the vehicle being suitable for following a path in space the vehicle oscillatable about a center of instantaneous rotation and the vehicle rotable about an axis, that is movable with the vehicle in accordance with oscillation of the vehicle, the vehicle is supported on a support structure comprising at least one rail the shape of which defines the shape of the oscillation of the vehicle, wherein sensor means are provided which are suitable to reading the position of the vehicle relative to the support structure in order to reverse the direction of oscillation of the vehicle.

32. Amusement apparatus comprising a vehicle for accommodating users, the vehicle being suitable for following a path in space the vehicle oscillatable about a center of instantaneous rotation and the vehicle rotable about an axis, that is movable with the vehicle in accordance with oscillation of the vehicle, the vehicle is supported on a support structure comprising at least one rail the shape of which defines the shape of the component due to oscillation of the vehicle, wherein the vehicle comprises a thrust track for its movement along the at least one rail, and wherein the thrust track has an arcuate configuration in accordance with a configuration similar to that of the at least one rail.

33. An amusement apparatus, comprising:

a support structure including at least one rail; and a vehicle configured to accommodate users, the vehicle configured to follow a path in space the vehicle oscillatable about a center of instantaneous rotation and the vehicle rotable about an axis that is movable with the vehicle in accordance with oscillation of the vehicle, a shape of the rails corresponding to a shape of the oscillation of the vehicle.

34. The amusement apparatus according to claim 33, wherein the rail is substantially stationary at least for a duration of a ride by the users.

* * * * *